United States Patent [19]

Newman et al.

[11] 4,057,203

[45] Nov. 8, 1977

[54] PACKAGE OF FLEXIBLE MATERIAL WITH OVAL PAYOUT TUBE

[75] Inventors: James W. Newman, Scarsdale; Ronald E. Zajac, Yonkers, both of N.Y.

[73] Assignee: Windings, Inc., Goldens Bridge, N.Y.

[21] Appl. No.: 686,569

[22] Filed: May 14, 1976

[51] Int. Cl.[2] ..... B65H 55/02

[52] U.S. Cl. ..... 242/163; 242/137.1; 242/157 R; 242/171

[58] Field of Search ..... 242/163, 170, 171, 159, 242/137, 137.1, 138, 141, 146, 157 R

[56] References Cited

U.S. PATENT DOCUMENTS

| | | | |
|---|---|---|---|
| 2,634,922 | 4/1953 | Taylor, Jr. | 242/163 |
| 2,716,008 | 8/1955 | Taylor, Jr. | 242/163 |
| 3,677,490 | 7/1972 | Gordon et al. | 242/163 |
| 3,677,491 | 7/1972 | Gerwig | 242/163 |

*Primary Examiner*—Stanley N. Gilreath
*Attorney, Agent, or Firm*—Watson, Cole, Grindle & Watson

[57] ABSTRACT

The invention relates to a package of material wound in a series of figure-8s with the cross-overs advancing around the package, and the cross-overs being omitted at at least one point on the circumference of the package to leave a radial hole into the center of the package for inner end feedout to allow payout without twist. This hole is ordinarily somewhat diamond shaped, with its major axis extending substantially perpendicular to the axis about which the material was wound. A payout tube is placed in that hole, this payout tube having an oval shape.

2 Claims, 4 Drawing Figures

PACKAGE OF FLEXIBLE MATERIAL WITH OVAL PAYOUT TUBE

BACKGROUND OF THE INVENTION

1. Field of the Invention

The invention relates to a package of flexible material wound in a series of figure-8s with a radial opening for inner end feedout and a payout tube within the opening.

2. The Prior Art

The use of tubes in packages of this type is shown for example in Gordon U.S. Pat. No. 3,677,490. Such tubes in the past have always been round in cross-section.

SUMMARY OF THE INVENTION

According to the present invention, a payout tube is formed in an oval shape to fit in the hole in the package, which, when such a hole is formed by reversing the direction of the cross-overs in each of the winding layers, ordinarily has a diamond shape and is somewhat elongated in the direction perpendicular to the axis about which the material was wound. The use of an oval tube both fills the hole to a greater degree, thus providing a greater amount of support for the material on each side of the hole, and at the same time allows some freedom of movement of the wound material, assuming that its diameter is less than the minor axis of the elliptical oval payout tube, which allows it to shift from one side of the tube to the other and improve the payout. This also permits the size of the hole to be reduced somewhat for large materials so that the amount of material in the coil can be increased.

DESCRIPTION OF THE PREFERRED EMBODIMENTS

Figure 1:
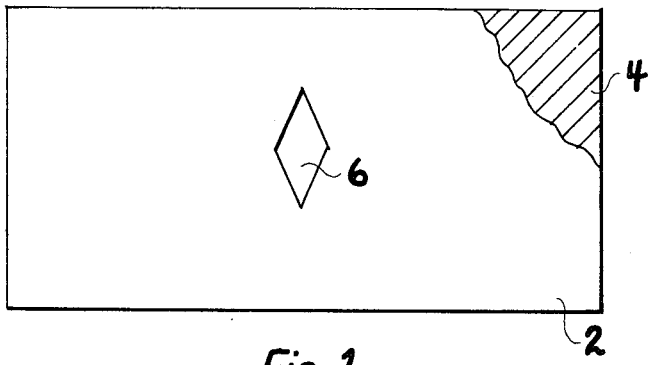
FIG. 1 shows in cross-section a package for a coil according to the invention.
Figure 2:
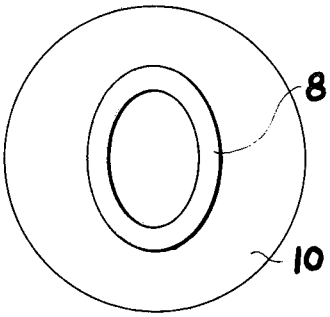
FIG. 2 shows an end view of the tube.
Figure 3:
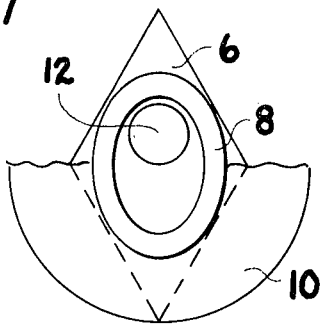
FIG. 3 is an enlargement of a part of the package showing a tube therein embodying the invention.

The arrangement shown in the drawings is a package comprising a container 2 in which is a coil 4 formed of flexible material wound in a series of figure-8 coils with the cross-overs progressing around the package, but interrupted at one point so as to leave a radial hole from the outside into the central core space of the wound material through which the inner end of the material can be drawn out.

In practice, this radial hole will ordinarily be longer in a direction perpendicular to the winding axis of the material than in a direction parallel to such axis, and ordinarily has a diamond shape.

The package container 2 has an opening 6 therein of diamond shape conforming generally to the shape of the opening in the coil. Within this there is arranged a tube which extends from the outside into the interior of the package, for guiding the material out of the package.

Figure 4:
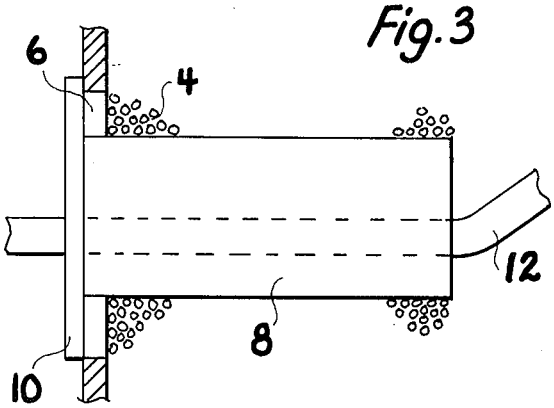
FIG. 4 shows in side elevation a tube embodying the invention combined with a package.

The tube is oval in cross-section with its major axis extending parallel to the major axis of the radial hole of the coil. The main body of the tube is indicated at 8. At its outer end it has a flange 10 which fits against the side wall of the container, by which it may be secured in position on the package, for example by an adhesive. The free inner end 12 of the material is brought out through the tube in a manner shown in FIG. 4. The diameter of the material is less than the minor axis of the tube.

We claim:

1. A package comprising a coil of flexible material wound in a plurality of layers of Figure-8 winds with the cross-overs progressing around the package in each layer and having a radial opening through the wall of the coil from the outside to a central core space of the wound flexible material, said radial opening having a greater length in the direction substantially perpendicular to the axis about which said material was wound, and a payout tube passing through said radial opening through which the inner end of the material is drawn out, said payout tube being oval in cross-section with its major axis extending parallelly to said perpendicular direction, the cross-section of the material being less than the minor axis of said payout tube.

2. A package as in claim 1 further comprising a container enclosing said coil and having an opening in a wall thereof, said last mentioned opening being aligned with said radial opening, and means securing said oval payout tube to said wall of the container.

* * * * *